US008821266B2

(12) United States Patent
Nicely

(10) Patent No.: US 8,821,266 B2
(45) Date of Patent: Sep. 2, 2014

(54) METHOD AND SYSTEM FOR PLAYER LINKED AUDIO

(75) Inventor: Mark C. Nicely, Daly City, CA (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 13/215,638

(22) Filed: Aug. 23, 2011

(65) Prior Publication Data

US 2013/0053144 A1 Feb. 28, 2013

(51) Int. Cl.
*A63F 9/24* (2006.01)

(52) U.S. Cl.
USPC ..... 463/29; 463/26; 463/35; 463/42

(58) Field of Classification Search
USPC ..... 370/401; 455/410; 463/16–20, 26, 42; 705/72
See application file for complete search history.

(56) References Cited

U.S. PATENT DOCUMENTS

| | | | | |
|---|---|---|---|---|
| 4,352,200 | A | 9/1982 | Oxman | |
| 5,832,024 | A | 11/1998 | Schotz et al. | |
| 6,510,182 | B1 | 1/2003 | Lee et al. | |
| 6,577,419 | B1 | 6/2003 | Hall et al. | |
| 6,671,325 | B2 | 12/2003 | Lee et al. | |
| 6,671,494 | B1 | 12/2003 | James | |
| 6,846,238 | B2 * | 1/2005 | Wells | 463/39 |
| 7,546,112 | B2 * | 6/2009 | Cheng | 455/404.2 |
| 8,064,889 | B2 * | 11/2011 | Griswold et al. | 455/414.1 |
| 8,147,316 | B2 * | 4/2012 | Arezina et al. | 463/20 |
| 2002/0093967 | A1 * | 7/2002 | Perlman et al. | 370/401 |
| 2002/0102949 | A1 | 8/2002 | Langer | |
| 2002/0160773 | A1 | 10/2002 | Gresham et al. | |
| 2003/0107248 | A1 | 6/2003 | Sanford et al. | |
| 2003/0182003 | A1 | 9/2003 | Takashima | |
| 2003/0195043 | A1 | 10/2003 | Shinners et al. | |
| 2004/0077308 | A1 | 4/2004 | Sanford et al. | |
| 2004/0125958 | A1 | 7/2004 | Brewster et al. | |
| 2004/0183346 | A1 | 9/2004 | Sanford et al. | |
| 2005/0003890 | A1 * | 1/2005 | Hedrick et al. | 463/29 |
| 2005/0216938 | A1 | 9/2005 | Brady, Jr. et al. | |
| 2006/0025206 | A1 * | 2/2006 | Walker et al. | 463/20 |
| 2006/0271967 | A1 | 11/2006 | So | |
| 2007/0021198 | A1 * | 1/2007 | Muir et al. | 463/29 |
| 2007/0037553 | A1 * | 2/2007 | Patel et al. | 455/410 |
| 2007/0238505 | A1 * | 10/2007 | Okada | 463/16 |
| 2008/0076572 | A1 * | 3/2008 | Nguyen et al. | 463/42 |
| 2008/0220878 | A1 * | 9/2008 | Michaelis | 463/42 |
| 2009/0005165 | A1 * | 1/2009 | Arezina et al. | 463/37 |

(Continued)

FOREIGN PATENT DOCUMENTS

WO WO-2009/108820 A2 9/2009

OTHER PUBLICATIONS

Extended European Search Report for Application No. 12171243.4, dated Nov. 15, 2012, 6 pages.

*Primary Examiner* — Dmitry Suhol
*Assistant Examiner* — Jason Yen
(74) *Attorney, Agent, or Firm* — Foley & Lardner LLP

(57) ABSTRACT

A method of linking gaming machine audio content to a player and network-based gaming system are provided. The system may include a gaming machine, a database, and a server system configured to be coupled to the gaming machine and the database. The server system may be associated with a server-based network configured to associate a connection identification (ID) with a listening device, receive an identification of the listening device through the gaming machine, and transmit an audio content generated by the gaming machine to the identified listening device using the connection ID.

21 Claims, 4 Drawing Sheets

(56) References Cited

U.S. PATENT DOCUMENTS

| | | | | |
|---|---|---|---|---|
| 2009/0124376 | A1* | 5/2009 | Kelly et al. | 463/29 |
| 2009/0264190 | A1* | 10/2009 | Davis et al. | 463/26 |
| 2010/0087241 | A1* | 4/2010 | Nguyen et al. | 463/17 |
| 2010/0153276 | A1* | 6/2010 | Wong | 705/72 |
| 2010/0234099 | A1* | 9/2010 | Rasmussen et al. | 463/29 |
| 2010/0298054 | A1* | 11/2010 | Liber et al. | 463/42 |
| 2010/0331079 | A1* | 12/2010 | Bytnar et al. | 463/29 |
| 2011/0109134 | A1* | 5/2011 | Filipour et al. | 297/217.4 |

* cited by examiner

METHOD AND SYSTEM FOR PLAYER LINKED AUDIO

BACKGROUND

The field of the disclosure relates generally to electronic gaming machines, and more specifically, to methods and systems for linking an audio output of any of a plurality of gaming machines to a personal listening device.

Sound is an important way to communicate information to a player in a casino. For example, sound can be used to attract a player to a game and to communicate information about how to play the game, paytable information, etc. Sounds can be used to prompt the player to perform certain tasks, to celebrate winning events, and to announce winning events to nearby players.

Accordingly, sounds produced by a gaming machine may be for the intended benefit of different "audiences." Some types of sounds produced by a gaming machine are intended for the person playing that gaming machine, whereas other sounds produced by the gaming machine are intended to be heard by other people.

A gaming machine experience can be enhanced when the player can hear and control the audio generated by the gaming machine during game play. However, sound management as part of gaming machine operation is often complex and variable. The ambient noise level in a casino varies greatly throughout the day. At peak times, a casino is quite loud. At off-peak times, however, a casino is relatively quiet.

The dynamic range of the ambient noise level creates a problem for game designers wishing to fully utilize sounds to communicate with players. If a gaming machine's volume is set high enough to be heard in the casino during peak times, it will be unpleasantly loud during non-peak times. The off-peak volume problem is sufficiently disturbing that casino personnel reduce the volume or disable the audio on sound-generating gaming machines to better control the overall soundscape of their casino.

During peak times, people in a gaming establishment are subjected to high-volume sounds, most of which are not intended for the person hearing the sounds. Moreover, some game designers may minimize the use of sounds because of the foregoing issues. Accordingly, if such sound-related problems were resolved, gaming machine sounds could be used more effectively and extensively for personal enjoyment by the players.

BRIEF DESCRIPTION

In one embodiment, a network-based gaming system for linking a gaming machine audio content with a player listening device may include a gaming machine, a database, and a server system configured to be coupled to the gaming machine and the database. The server system may be associated with a server-based network configured to associate a connection identification ("ID") with a listening device, receive an identification of the listening device through the gaming machine, and transmit an audio content generated by the gaming machine to the identified listening device using the connection ID.

In another embodiment, a method of linking gaming machine audio content to a player may include associating a connection identification (ID) with a listening device, receiving an identification of the listening device by a gaming machine, and transmitting an audio content generated by the gaming machine to the identified listening device using the connection ID.

In yet another embodiment, a gaming machine system may include a radio frequency ("RF") transmitter, an audio sound generator device, and a processor coupled to the transmitter and the audio sound generator device and configured to associate a connection identification (ID) with a listening device, receive an identification of the listening device by the gaming machine system, and transmit an audio content generated by the gaming machine to the identified listening device using the connection ID.

BRIEF DESCRIPTION OF THE DRAWINGS

FIG. 1 is a schematic block diagram of a server-based gaming network in accordance with an exemplary embodiment;

FIG. 2 is a perspective view of an electronic gaming machine (EGM) n accordance with an exemplary embodiment;

FIG. 3 is a data flow diagram of a player linked audio system for gaming machines in accordance with an exemplary embodiment; and FIG. 4 is a flow chart of a method of linking gaming machine audio content to a player in accordance with an exemplary embodiment.

DETAILED DESCRIPTION

The following detailed description illustrates embodiments of the disclosure by way of example and not by way of limitation. It is contemplated that the disclosure has general application to analytical and methodical embodiments of linking audio content between a listening device and a plurality of separate audio content generators in industrial, commercial, and residential applications.

As used herein, an element or step recited in the singular and preceded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

Embodiments of the present disclosure describe matching a player's listening device with a unique ID, for example, but not limited to, a player tracking card. In exemplary embodiments, a player could use wired headphones plugged into a jack on the gaming machine to experience enhanced audio or link a Bluetooth listening device such as an in-ear-phone headset.

Using the unique connection ID, the casino may provide a one-time service that associates the connection ID with a given player and configures the player's listening device accordingly. Then, whenever the player sits at an enabled EGM and is identified (via player card or code entered into Sbx™, etc.) the EGM may configure itself to broadcast using the ID expected by that player's device. When the player ends the session by, for example, removing the card, walking away from the machine, etc., the broadcasting stops.

In one embodiment, the player may control broadcast audio separately from EGM audio. In one embodiment, a given device may be configured to work with two or more IDs. When a player "registers" with a given EGM, a linked system of controllers knows if any nearby players are using the same primary global ID as the new player and, if so, the system may select a secondary global ID so as to avoid conflict.

Figure 1:
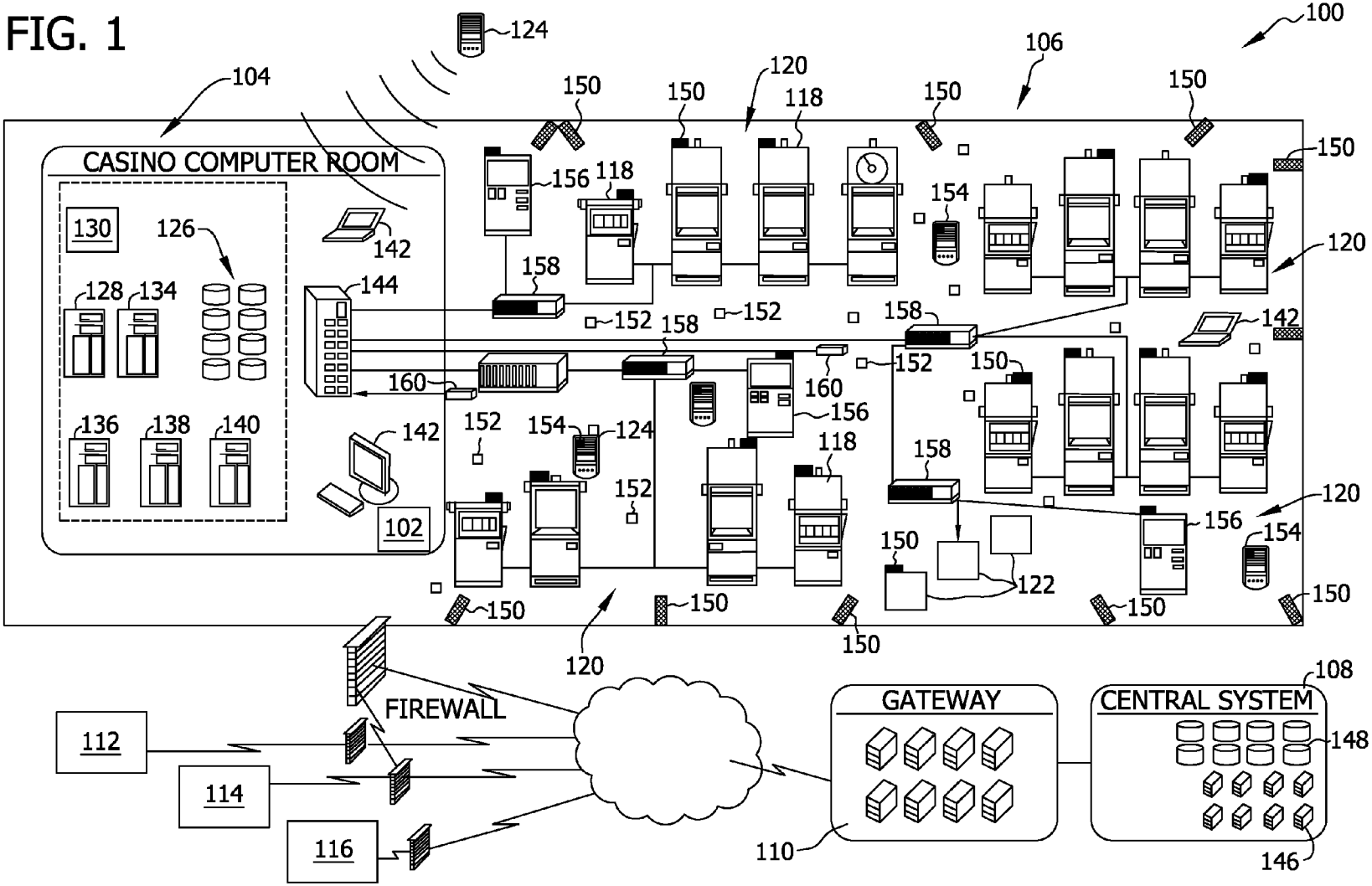
FIGS. 1-4 show exemplary embodiments of the method and system described herein.

FIG. 1 is a schematic block diagram of a server-based gaming network 100 in accordance with an exemplary embodiment of the present invention. In the exemplary embodiment, network 100 may include a player audio link system 102 incorporated therein. In an embodiment, player audio link system 102 may be a stand-alone system communicatively coupled to network 100. In various embodiments, player audio link system 102 may be incorporated within various components of network 100. Player audio link system 102 may also be wholly contained in a single electronic gaming machine or in a controller communicatively coupled to a bank of electronic gaming machines.

Network 100 may provide methods and devices for managing one or more networked gaming establishments. Network 100 may be embodied in what is known as a server-based gaming network, Sbx™ network. In one embodiment, network 100 may permit the convenient provisioning of networked gaming machines and other devices relevant to casino operations. Game themes may be easily and conveniently added or changed, if desired. Related software, including but not limited to player tracking software and peripheral software may be downloaded to networked gaming machines, mobile gaming devices, thin clients and/or other devices, such as kiosks, networked gaming tables, and player stations.

In some implementations, servers or other devices of a central system may determine game outcomes and/or provide other wager gaming functionality. In some such implementations, wagering games may be executed primarily on one or more devices of a central system, such as a server, a host computer, etc. For example, wager gaming determinations such as interim and final game outcomes and bonuses may be made by one or more servers or other networked devices. Player tracking functions, accounting functions and some display-related functions associated with wagering games may be performed, at least in part, by one or more devices of a casino network and/or of a central system.

In the exemplary embodiment, network 100 may include a casino computer room 104 and networked devices of a gaming establishment 106. Gaming establishment 106 may be configured for communication with a central system 108 via a gateway 110. Other gaming establishments 112, 114, and 116 may also be configured for communication with central system 108.

Gaming establishment 106 may include multiple gaming machines 118. Some of gaming machines 118 may form a cluster or "bank" 120 of gaming machines 118. Gaming machines 118 may be configured for communication with one or more devices of casino computer room 104 or similar devices disposed elsewhere in gaming establishment 106. Some of gaming machines 118 may be configured to read from, and/or write information to, a portable instrument such as but not limited to, a ticket and a player loyalty device.

In the exemplary embodiment, gaming establishment 106 may also include a bank of networked gaming tables 122. However, network 100 may be implemented in gaming establishments having any number of gaming machines, gaming tables, etc. It may be appreciated that many gaming establishments 106 include hundreds or even thousands of gaming machines 118, gaming tables 122 and/or mobile devices 124, not all of which may necessarily be associated bank 120 and some of which may not be connected to network 100. At least some of gaming machines 118 and/or mobile devices 124 may be "thin clients" that are configured to operate, at least in part, according to instructions from another device (such as a server).

A plurality of storage devices 126, Sbx™ server 128, License Manager 130, servers 134, 136, 138, and 140, host device(s) 142, and main network device 144 may be disposed within computer room 104 of gaming establishment 106. In practice, more or fewer devices may be used. Depending on the implementation, some such devices may reside elsewhere in gaming establishment 106.

One or more of the devices in computer room 104 (or similar devices disposed elsewhere in gaming establishment 106 or in gaming establishment 112, 114, or 116) may be configured to provide functionality relevant to various embodiments. For example, one or more of servers 134, 136, 138, or 140 may be configured for communication with gaming machines 118 that may be configured to provide a subset of themes for selection by a player. For example, one or more such servers may be configured to provide a selection of a subset of four themes from a large number of available themes.

Accordingly, in some embodiments at least some gaming establishments may be configured for communication with one another. In this example, gaming establishments 112, 114, and 116 may be configured for communication with casino computer room 104. Such a configuration may allow devices and/or operators in casino 106 to communicate with and/or control devices in other casinos. In some such implementations, a server (or another device) in computer room 104 may be configured to communicate with and/or control devices in gaming establishments 112, 114, and 116. Conversely, devices and/or operators in another gaming establishment may communicate with and/or control devices in casino 106.

Some of these servers in computer room 104 may be configured to perform tasks relating to accounting, player loyalty, bonusing/progressives, configuration of gaming machines, etc. A Radius server and/or a DHCP server may also be configured for communication with the gaming network. In various embodiments, Sbx™ server 128 and the other servers shown in FIG. 1 may include or may be in communication with clustered CPUs, redundant storage devices, including backup storage devices, switches, etc. Such storage devices may include a redundant array of independent disks (RAID) array, back-up hard drives and/or tape drives, etc.

In various embodiments, many of these devices (including, but not limited to, License Manager 130, servers 134, 136, 138, and 140, and main network device 144) may be mounted in a single rack with Sbx™ server 128. Accordingly, many or all such devices will sometimes be referenced in the aggregate as an "Sbx™ server." However, in alternative implementations, one or more of these devices may be in communication with Sbx™ server 128 and/or other devices of the network but located elsewhere. For example, some of the devices may be mounted in separate racks within computer room 104 or located elsewhere on the network. Moreover, in some implementations large volumes of data may be stored elsewhere, e.g., via a storage area network ("SAN").

Computer room 104 may include one or more operator consoles or other host devices that are configured for communication with other devices within and outside of computer room 104. Such host devices may be provided with software, hardware and/or firmware for implementing functions described herein. However, such host devices need not be located within computer room 104. Wired host devices 142 (which are desktop and laptop computers in this example) and wireless devices 124 (which are PDAs in this example) may be located elsewhere in gaming establishment 106 or at a remote location.

Some embodiments include devices for implementing access control, security and/or other functions relating to the communication between different devices on the network.

One or more devices in central system 108 may also be configured to perform, at least in part, tasks specific to various embodiments. For example, one or more servers 146, storage devices and/or host devices 142 of central system 108 may be configured to implement the functions described in detail elsewhere herein. One or more servers 146, storage devices 148 and/or host devices 142 of central system 108 may maintain player account information.

Some gaming networks 100 may provide features for gaming tables that are similar to those provided for gaming machines, including but not limited to bonusing, player loyalty/player tracking, the use of cashless instruments, etc. Some configurations may provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras 150, radio frequency identification devices 152 and 154, etc., may be used to identify and/or track patrons, playing cards, chips, etc. Some of gaming tables 122 may be configured for communication with individual player terminals (not shown), which may be configured to accept bets, present an electronic representation of a dealer, indicate game outcomes, etc.

Moreover, some such automated gaming tables 122 and/or associated player terminals may include, or may be configured for communication with, a device that includes a coin-out meter, a ticket reader, a card reader, a ticket printer, and/or other related features. In some implementations, one such device may provide such functionality to a plurality of automated gaming tables 122 and/or associated player terminals.

Gaming establishment 106 also includes networked kiosks 156. Kiosks 156 may include card readers, ticket readers, printers, a user interface system, one or more displays, etc. Depending on the implementation, kiosks 156 may be used for various purposes, including but not limited to cashing out, prize redemption, redeeming points from a player loyalty program, redeeming "cashless" indicia such as bonus tickets, smart cards, etc.

Kiosks 156 may be configured to read information from, and/or write information to, a portable instrument such as a smart card, a ticket, a card having a magnetic strip, etc. The corresponding gaming devices may be configured for communication with such kiosks 156 and vice versa. Accordingly, some such kiosks 156 may include a wireless interface that may be configured for communication with mobile gaming devices 124.

In the exemplary embodiment, each bank 120 has a corresponding switch 158. Each switch 158 is configured for communication with one or more devices in computer room 104 via main network device 144, which combines switching and routing functionality in this example. Although various communication protocols may be used, some implementations may use the Gaming Standards Association's G2S Message Protocol. Some systems may use a gaming-industry-specific transport layer called CASH™, which offers additional functionality and security.

Gaming establishment 106 may also include an RFID network, implemented in part by RFID switches 160 and multiple RFID readers 152. An RFID network may be used, for example, to track objects such as mobile gaming devices 124, which include RFID tags 154, patrons, chips, player loyalty devices, etc., in the vicinity of gaming establishment 106.

Various alternative network topologies may be used to implement different aspects of the disclosure and/or to accommodate varying numbers of networked devices. For example, some gaming establishments may include cameras 150 for implementing advanced player tracking, player navigation or other functionality. Gaming establishments with large numbers of gaming machines 118 may require multiple instances of some network devices (e.g., of main network device 144, which combines switching and routing functionality in this example) and/or the inclusion of other network devices not shown in FIG. 1. Some embodiments may include one or more middleware servers disposed between kiosks 156, RFID switches 160 and/or bank switches 158 and one or more devices (e.g., a corresponding server, router or other network device) in computer room 104. Such middleware servers may provide various useful functions, including but not limited to the filtering and/or aggregation of data received from switches, from individual gaming machines and from other devices. Some implementations of the disclosure may include load-balancing methods and devices for otherwise managing network traffic.

Figure 2:
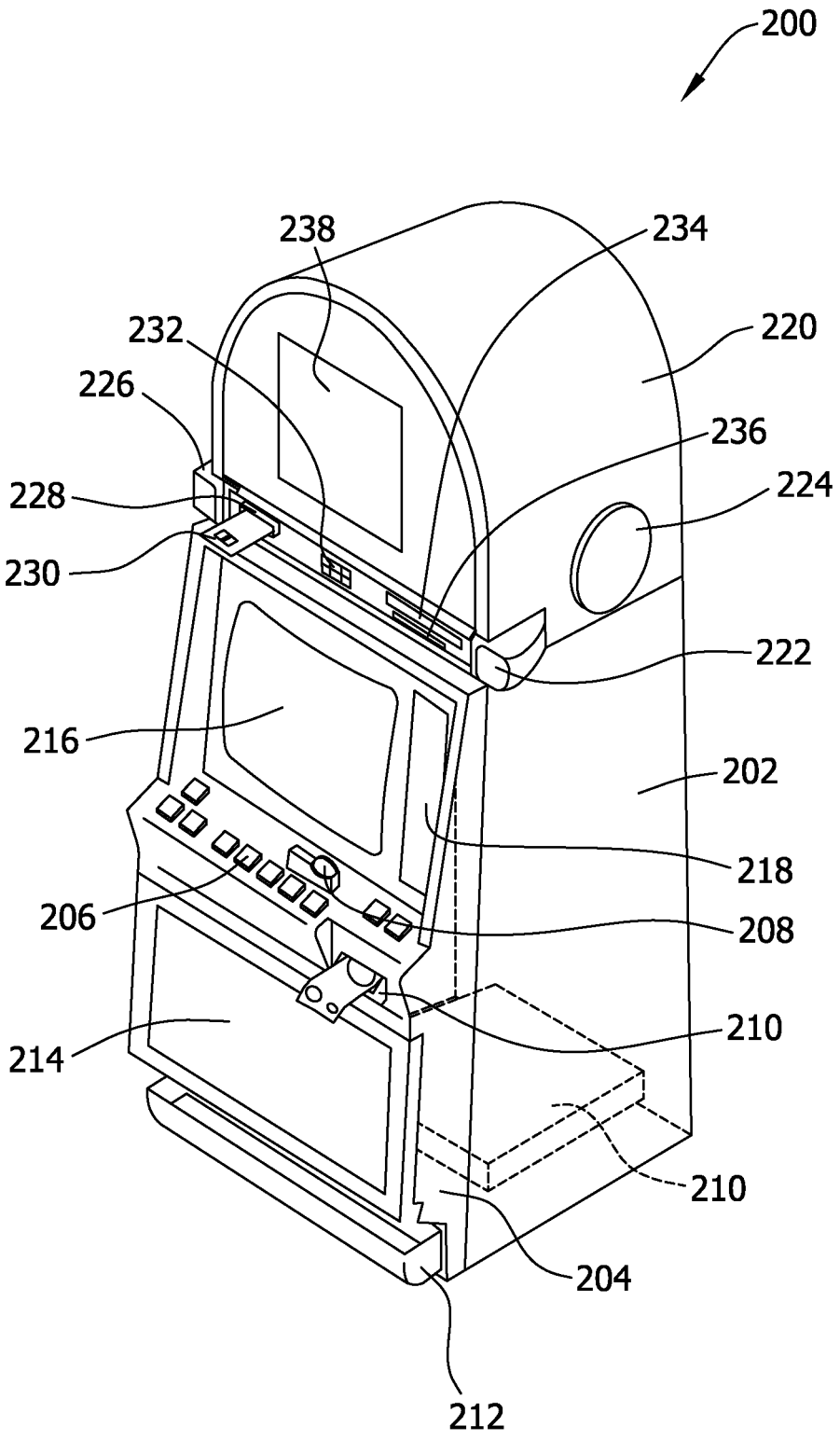

FIG. 2 is a perspective view of an electronic gaming machine (EGM) 200 in accordance with an exemplary embodiment. In the exemplary embodiment, EGM 200 may include a main cabinet 202, which generally surrounds an interior of EGM 200 and is viewable by users or players. Main cabinet 202 may include a main door 204 on the front of EGM 200, which opens to provide access to the interior of EGM 200. Additional components may be attached to the main door 204, including player-input switches or buttons 206, a coin acceptor 208, a bill validator 210, a coin tray 212, and a belly glass 214. A video display monitor 216 and an information panel 218 may be viewable through the main door 204. Display monitor 216 may be any conventional electronically controlled video monitor such as a cathode ray tube, or a flat-panel monitor using technology such as plasma, LCD, or LED. Information panel 218 may be a back-lit, silk screened glass panel with lettering to indicate general game information including, for example, a game denomination (e.g., $0.25 or $1). Player-input switches 206, bill validator 210, video display monitor 216, and information panel 218 are all devices used by a player to initiate and/or play a game on EGM 200. These devices may be controlled by circuitry (e.g., a master gaming controller) housed inside main cabinet 202 of EGM 200. Many different types of games, including mechanical slot games, video slot games, video poker, video black jack, video pachinko, and lottery, may be provided by EGM 200. Typically, games provided by EGM 200 are electronic games of chance found in a casino and subject to jurisdictional regulations governing gambling and casino operations in general. The various games presentable on an EGM 200 may be differentiated according to themes, sounds, graphics, game type (e.g., slot game vs. card game), denomination, number of paylines, maximum jackpot, progressive or non-progressive style, bonus games, etc. EGM 200 may be operable to allow a player to select a game of chance to play from a plurality of instances available on EGM 200. For example, EGM 200 may provide a menu with a list of the instances of games that are available for play on EGM 200 and a player may be able to select from the list a first instance of a game of chance that they wish to play.

The various instances of games available for play on EGM 200 may be stored as game software on a mass storage device in EGM 200 or may be generated on a remote gaming device but then displayed on EGM 200. EGM 200 may execute game software, such as, but not limited to, video streaming software that allows the game to be displayed on EGM 200. When an instance of a game is stored on EGM 200, it may be loaded from the mass storage device into a RAM for execution. In some cases, after a selection of an instance, the game software that allows the selected instance to be generated may be downloaded from a remote gaming device, such as another gaming machine.

EGM 200 may also include a top box 220, which sits on top of main cabinet 202. Top box 220 may house a number of devices, which may be used to add features to a game being played on EGM 200, including speakers 222, 224, 226, a ticket printer 228 that prints bar-coded tickets 230, a key pad 232 for entering player tracking information, a fluorescent display 234 for displaying player tracking information, and a card reader 236 for entering a magnetic striped card containing player tracking information. Card reader 236 is one example of a verification interface. Ticket printer 228 may be used to print tickets for a cashless ticketing system. Further, top box 220 may house different or additional devices than those shown in FIG. 2. For example, the top box 220 may contain a bonus wheel (not shown) or a back-lit silk-screened panel (not shown) that may be used to add bonus features to the game being played on EGM 200. As another example, the top box 220 may contain a display 238 for displaying information about a progressive jackpot offered on EGM 200. During a game, the various electronic devices within EGM 200 may be controlled and powered, in part, by circuitry 240 housed within main cabinet 202. Circuitry 240 may include, for example, a logic system having one or more processors such as a master game controller, memory configured for communication with the logic system and for storing game software, and coin-in and coin-out metering circuits, as well as power supplies and other supporting digital and analog electronics.

It should be understood that EGM 200 is but one example from a wide range of gaming machine designs on which the present disclosure may be implemented. For example, not all suitable gaming machines have top boxes or player tracking features. Further, some gaming machines may have only a single game display—mechanical or video, while others are designed for bar tables and have displays that face upward. As another example, a game may be generated in on a host computer and may be displayed on a remote terminal or a remote gaming device. The remote gaming device may be connected to the host computer via a wired or wireless network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further, a gaming machine or server may include gaming logic for commanding a remote gaming device to render an image from a virtual camera in a 3-D gaming environments stored on the remote gaming device and to display the rendered image on a display located on the remote gaming device. Thus, various embodiments of the present disclosure, as described herein, can be deployed on modified versions of many gaming machines now available, on other types of devices, such as those described above, or on other devices that may be hereafter developed.

Figure 3:
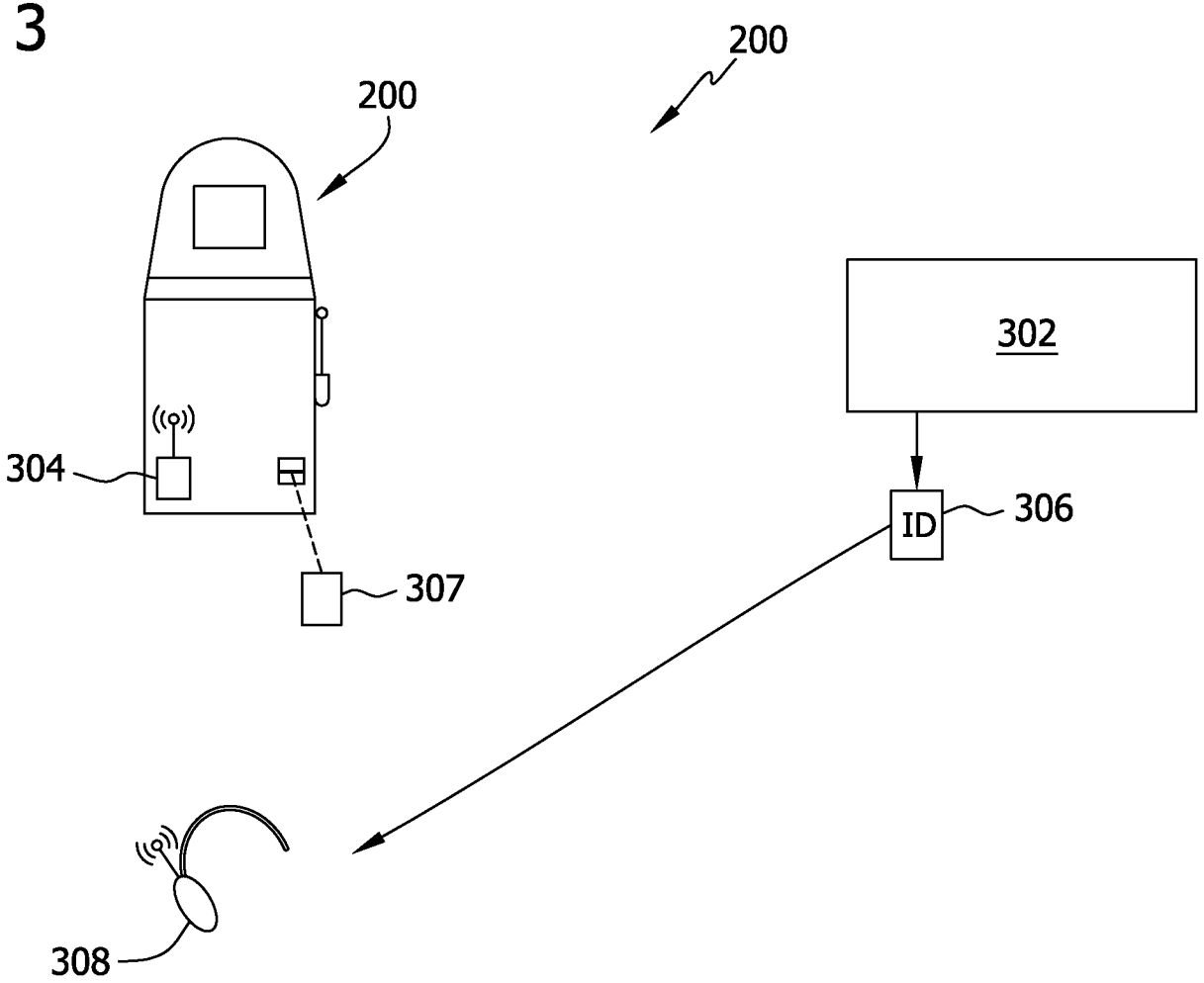

FIG. 3 is a data flow diagram of player linked audio system 300 for gaming machines in accordance with an exemplary embodiment. In the exemplary embodiment, system 300 may include a data entry kiosk 302 and a transmitter 304 communicatively coupled to a gaming machine, such as, but not limited to, EGM 200 (shown in FIG. 2). In various embodiments, transmitter 304 may be a transceiver configured to broadcast information and to receive information wirelessly. In one embodiment, kiosk 302 may be embodied within a customer service counter (not shown) of a gaming establishment such as, but not limited to, a casino and attended to by a customer service employee to assist players using data entry kiosk 302. In various other embodiments, kiosk 302 may be embodied as a standalone cabinet within the gaming establishment and configured to be self service by the player. In the exemplary embodiment, kiosk 302 may receive a player identification and associates the player identification with a unique connection identifier (ID) 306. The player may present a government issued ID card, player loyalty card 307, or may simply identify themselves using a user name and a password. The player may then use connection ID 306 with their own listening device 308 or a listening device provided by the gaming establishment to configure listening device 308 for communication with transmitter 304. The player may select one EGM 200 from a plurality of EGMs on the casino floor to play. The player or a module may identify listening device 308 to EGM 200. EGM 200 may begin broadcasting the audio gaming sounds generated by EGM 200 from transmitter 304 to listening device 308. Connection ID 306 may be used to link the selected EGM 200 transmitter to the identified listening device 308. In one embodiment, listening device 308 may be a Bluetooth enabled device and connection ID 306 may be associated with a Bluetooth address of listening device 308. In another embodiment, listening device 308 may be a cell phone and connection ID 306 may be associated with a phone number of listening device 308. Depending on a type of device that listening device 308 is embodied, connection ID 306 may be used to associate the access parameters needed to initiate communication between transmitter 304 and listening device 308.

When the player ends the game, for example, by collecting a payout and/or removing player loyalty card 307, affirmatively ends communication by transmitter 304, or simply moves out of range of transmitter 304, communication between transmitter 304 and listening device 308 may be ended. The gaming machine may be released to initiate communication with another player. The player may also then be able to move to another EGM 200 and initiate communication between a transmitter associated with that EGM 200 and listening device 308 using connection ID 306. Because connection ID links each EGM 200 with address information of the player's listening device 308, the player only has to identify listening device 308 to EGM 200 to initiate communication between transmitter 304 and listening device 308.

In various embodiments, the audio content may be audio content generated by EGM 200 during game play including instructions provided to the player, explanations of payout events, or other help topics. Moreover, if listening device 308 may be equipped with a microphone, such as a Bluetooth enabled device or a cell phone, the player may communicate through listening device 308 to casino personal, such as, but not limited to, a customer service attendant.

Figure 4:
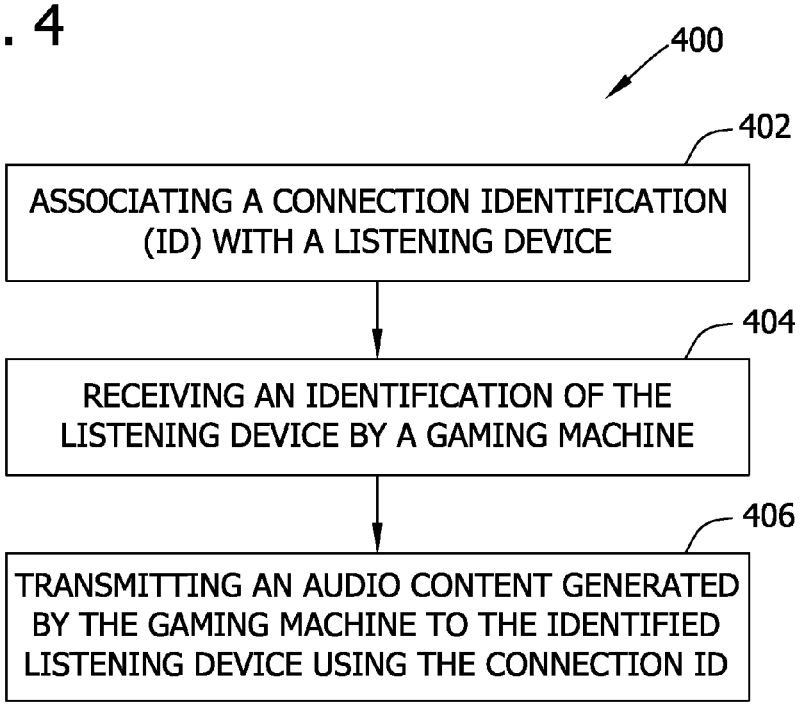

FIG. 4 is a flow chart of a method 400 of linking gaming machine audio content to a player in accordance with an exemplary embodiment of the present invention. In the exemplary embodiment, method 400 may include associating 402 a connection identification (ID) with a listening device, receiving 404 an identification of the listening device by a gaming machine, and transmitting 406 an audio content generated by the gaming machine to the identified listening device using the connection ID.

The term processor, as used herein, refers to central processing units, microprocessors, microcontrollers, reduced instruction set circuits (RISC), application specific integrated circuits (ASIC), logic circuits, and any other circuit or processor capable of executing the functions described herein.

As used herein, the terms "software" and "firmware" are interchangeable, and include any computer program stored in memory for execution by a processor, including RAM memory, ROM memory, EPROM memory, EEPROM memory, and non-volatile RAM (NVRAM) memory. The above memory types are exemplary only, and are thus not limiting as to the types of memory usable for storage of a computer program.

As will be appreciated based on the foregoing specification, the above-described embodiments of the disclosure may be implemented using computer programming or engineering techniques including computer software, firmware, hardware or any combination or subset thereof, wherein the technical effect is linking data content between a receiving device and a plurality of separate data content generators using a unique ID associated with the receiving device. The unique ID is embodied in the receiving device, is a separate device readable by the data content generators, or is manually entered into the data content generator. The unique connection ID is associated with a given player and the receiving device is configured accordingly. Then, whenever the listening device is identified to the data content generator, the data content generator configures itself to broadcast to that receiving device using the connection ID expected by the receiving device. When the session is ended, the broadcasting stops. Any such resulting program, having computer-readable code means, may be embodied or provided within one or more computer-readable media, thereby making a computer program product, i.e., an article of manufacture, according to the discussed embodiments of the disclosure. The computer readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

The above-described embodiments of a method and system of linking gaming machine audio content to a player provides a cost-effective and reliable means for linkage of a unique player ID and wireless connectivity to a player's listening device. More specifically, the methods and systems described herein facilitate improving a gaming experience by permitting a player to hear and control the audio generated by a gaming machine during game play. As a result, the methods and systems described herein facilitate improving game play in a cost-effective and reliable manner.

This written description uses examples to disclose the various embodiments, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A network-based gaming system for linking a gaming machine audio content with a player listening device, the system comprising:

a gaming machine;

a database; and a server system configured to be coupled to the gaming machine and the database, the server system associated with a server-based network, the server system configured to:

associate two connection identifications (IDs) with a listening device, the two connection IDs including a primary connection identification (ID) and a secondary connection ID;

associate the at least two connection IDs with a player;

receive an indication that the player is playing the gaming machine;

in response to receiving the indication, determine that another player is using the primary connection ID; and configure the gaming machine to use the secondary connection ID to initiate audio content generated by the gaming machine during game play by the player to be transmitted to the listening device.

2. The system in accordance with claim 1, wherein the gaming machine further comprises a transmitter configured to wirelessly broadcast the audio content generated by the gaming machine.

3. The system in accordance with claim 2, wherein the transmitter is operable to permit a player to control the audio content generated by the gaming machine during game play.

4. The system in accordance with claim 1, wherein the server is configured to receive addressing information for the listening device.

5. The system in accordance with claim 1, further comprising a kiosk coupled to the server system, and wherein the server system is further configured to receive a player identification through the kiosk.

6. The system in accordance with claim 1, wherein the server system is further configured to allow a player to communicate with casino personal through the listening device during game play.

7. A method of linking gaming machine audio content to a player, the method comprising:

associating two connection identifications (IDs) with a listening device, the two connection IDs including a primary connection identification (ID) and a secondary connection ID;

associating the two connection IDs with a player;

receiving an indication that the player is playing a gaming machine; and in response to receiving the indication that the player is playing the gaming machine, determining that another player is using the primary connection ID; and transmitting an audio content generated by the gaming machine during game play by the player to the listening device using the secondary connection ID.

8. The method in accordance with claim 7 wherein associating the two connection identifications (IDs) with a listening device further comprises associating the two connection identifications (IDs) with a phone number of a cell phone of the player.

9. The method in accordance with claim 7 wherein associating the two connection identifications (IDs) with a listening device further comprises associating a connection identifications (IDs) with an address of a Bluetooth headset of the player.

10. The method in accordance with claim 7 wherein receiving an identification of the listening device further comprises: initiating a near field radio frequency (RF) field proximate the gaming machine; reading a near field communication (NFC) tag associated with the listening device when the listening device is positioned in the near field RF field; and establishing a NFC link between the listening device and the gaming machine using information read from the NFC tag; and receiving the two connection IDs from the listening device by the gaming machine using the NFC link.

11. The method in accordance with claim 7 wherein transmitting an audio content generated by the gaming machine further comprises transmitting the audio content wirelessly.

12. The method in accordance with claim 7 wherein transmitting an audio content generated by the gaming machine further comprises transmitting the audio content through a network to a server communicatively coupled to the listening device.

13. The method of claim 7, further comprising allowing a player to communicate with casino personal through the listening device during game play.

14. The method of claim 7, further comprising stopping the transmitting of the audio content to the listening device upon receiving an indication that the player has stopped playing the gaming machine.

15. The method of claim 14, wherein the receiving an indication that the player has stopped playing the gaming machine comprises detecting removal of a player loyalty card or determining that the player has cashed out of the gaming machine.

16. A gaming machine system comprising:

a radio frequency (RF) transmitter;

an audio sound generator device; and a processor coupled to the RF transmitter and the audio sound generator device and configured to:

receive an indication that a player is playing the gaming machine, wherein the player has an associated listening device having two connection identifications (IDs), the two connection IDs including a primary connection identification (ID) and a secondary connection ID;

receive an identification of the listening device by the gaming machine system;

in response to receiving the indication and the identification, determine that another player is using the primary connection ID; and transmit an audio content generated by the gaming machine during game play by the player to the listening device using the secondary connection ID.

17. The system in accordance with claim 16, wherein the processor is further configured to associate the two connection identifications (IDs) with a phone number of a cell phone of a player.

18. The system in accordance with claim 16, wherein the processor is further configured to associate the two connection identifications (IDs) with an address of a Bluetooth headset of the player.

19. The system in accordance with claim 16, wherein the processor is further configured to: initiate a near field radio frequency (RF) field proximate the gaming machine using the RF transmitter; read a near field communication (NFC) tag associated with the listening device when the listening device is positioned in the near field RF field; and establish a NFC link between the listening device and the RF transmitter using information read from the NFC tag; and receive the two connection IDs from the listening device using the NFC link.

20. The system in accordance with claim 16, wherein the RF transmitter further comprises a receiver section configured to receive RF communications wirelessly from the listening device.

21. The system in accordance with claim 16, wherein the processor is further configured to allow a player to communicate with casino personal through the listening device during game play.

* * * * *

UNITED STATES PATENT AND TRADEMARK OFFICE

CERTIFICATE OF CORRECTION

PATENT NO. : 8,821,266 B2
APPLICATION NO. : 13/215638
DATED : September 2, 2014
INVENTOR(S) : Mark C. Nicely It is certified that error appears in the above-identified patent and that said Letters Patent is hereby corrected as shown below:

IN THE CLAIMS

In Claim 1, Column 10, Line 5, after “associate” and “two” insert --at least--.
In Claim 3, Column 10, Line 24, replace “a” with --the--.
In Claim 4, Column 10, Line 27, between “server” and “is” insert --system--.
In Claim 6, Column 10, Line 34, replace “a” with --the--.
In Claim 6, Column 10, Line 35, replace “personal” with --personnel--.
In Claim 8, Column 10, Line 53, replace “a” with --the--.
In Claim 9, Column 10, Line 58, replace “a” with --the--.
In Claim 9, Column 10, Lines 59 to 60, replace “identifications” with --identification--.
In Claim 9, Column 10, Line 60, replace “(IDs)” with --(ID)--.
In Claim 10, Column 10, Line 63, replace “an” with --the--.
In Claim 10, Column 10, Line 67, delete “and”.
In Claim 11, Column 11, Line 6, replace “an” with --the--.
In Claim 12, Column 11, Line 9, replace “an” with --the--.
In Claim 13, Column 11, Line 13, replace “a” with --the--.
In Claim 13, Column 11, Line 14, replace “personal” with --personnel--.
In Claim 15, Column 11, Line 20, replace “an” with --the--.
In Claim 16, Column 11, Line 30, replace “the” with --a--.
In Claim 17, Column 12, Line 12, replace “a” with --the--.
In Claim 19, Column 12, Line 22, delete “and”.
In Claim 21, Column 12, Line 31, replace “a” with --the--.
In Claim 21, Column 12, Line 32, replace “personal” with --personnel--.

Signed and Sealed this
Twentieth Day of October, 2015

Michelle K. Lee

Michelle K. Lee
*Director of the United States Patent and Trademark Office*